US012791039B2

(12) United States Patent
Cosentino et al.

(10) Patent No.: US 12,791,039 B2
(45) Date of Patent: Nov. 10, 2026

(54) FLUID PUMP AND METHOD THEREOF

(71) Applicant: ElectroSea, LLC, Plymouth, MN (US)

(72) Inventors: Louis Ciro Cosentino, Palm Beach Gardens, FL (US); Daniel L. Cosentino, Wayzata, MN (US); Brian Alan Golden, Eden Prairie, MN (US); Peter Samuel Broen Finzell, Shoreview, MN (US)

(73) Assignee: ElectroSea, LLC, Plymouth, MN (US)

( * ) Notice: Subject to any disclaimer, the term of this patent is extended or adjusted under 35 U.S.C. 154(b) by 0 days.

(21) Appl. No.: 18/640,130

(22) Filed: Apr. 19, 2024

(65) Prior Publication Data

US 2024/0352945 A1 Oct. 24, 2024

Related U.S. Application Data

(60) Provisional application No. 63/589,090, filed on Oct. 10, 2023, provisional application No. 63/518,420, filed on Aug. 9, 2023, provisional application No. 63/460,755, filed on Apr. 20, 2023.

(51) Int. Cl.
*F04D 29/42* (2006.01)
*F04D 29/08* (2006.01)

(52) U.S. Cl.
CPC ..... *F04D 29/426* (2013.01); *F04D 29/086* (2013.01)

(58) Field of Classification Search
CPC .... F04D 29/426; F04D 29/086; F04D 29/026; F04D 29/628; F04D 29/4233; F04D 29/4213; F16L 19/028; F16L 19/025; F16L 55/1286; F16L 55/115
See application file for complete search history.

(56) References Cited

U.S. PATENT DOCUMENTS

| | | | | |
|---|---|---|---|---|
| 3,967,915 | A * | 7/1976 | Litzenberg | F04D 29/4266 415/227 |
| 5,779,456 | A | 7/1998 | Bowes et al. | |
| 11,027,991 | B2 | 6/2021 | Cosentino et al. | |
| 12,044,339 | B2 * | 7/2024 | Bayyouk | F16L 19/0206 |
| 2008/0031748 | A1 * | 2/2008 | Ihle | F04D 29/426 29/888.024 |
| 2014/0377055 | A1 * | 12/2014 | Garvin | F04D 29/2205 415/121.1 |
| 2020/0299985 | A1 * | 9/2020 | Saccoccio | F16L 25/14 |

(Continued)

OTHER PUBLICATIONS

Finish Thompson GMBH; DB 11/15 Series Assembly, Installation and Operation Manual; Sep. 15, 2015; pp. 1-19; Finish Thompson Inc.; Erie, Pennsylvania.

(Continued)

*Primary Examiner* — Nathaniel E Wiehe
*Assistant Examiner* — Maxime M Adjagbe
(74) *Attorney, Agent, or Firm* — Merchant & Gould P.C.

(57) ABSTRACT

A fluid pump includes a main housing body that at least partially defines a pump chamber. The main housing body integrally forms a volute wall such that secondary cavities are not formed within the pump chamber. The volute wall may be part of a face wall with an inner surface at least partially forming the pump chamber and an exterior surface at least partially forming an outer surface of the main housing body. A reinforcement ring may be integrated with the main housing body and surrounding a port axis of an inlet port.

18 Claims, 10 Drawing Sheets

(56) References Cited

U.S. PATENT DOCUMENTS

| | | | | |
|---|---|---|---|---|
| 2021/0270308 | A1* | 9/2021 | Riedel, Jr. | F16B 37/16 |
| 2022/0065265 | A1* | 3/2022 | Chen | F04D 13/0606 |
| 2022/0403852 | A1* | 12/2022 | Pae | F04D 29/026 |
| 2023/0193923 | A1* | 6/2023 | Shane | F04D 29/426 415/203 |

OTHER PUBLICATIONS

Finish Thompson GMBH; DB 11/15 Series Assembly, Installation And Operation Manual; Aug. 1, 2016; pp. 1-22; Finish Thompson Inc.; Erie, Pennsylvania.

Finish Thompson GMBH; DB6, 6H, 7, 8, 9, 10 Series Centrifugal Pumps, Assembly, Installation and Operation Manual; Aug. 1, 2016; pp. 1-18; Finish Thompson Inc.; Erie, Pennsylvania.

* cited by examiner

FLUID PUMP AND METHOD THEREOF

CROSS-REFERENCE TO RELATED APPLICATIONS

This application claims priority to and the benefit of U.S. Provisional Application Ser. No. 63/460,755, filed Apr. 20, 2023, U.S. Provisional Application Ser. No. 63/518,420, filed Aug. 9, 2023, and U.S. Provisional Application Ser. No. 63/589,090, filed Oct. 10, 2023, the disclosures of which are hereby incorporated by reference in their entireties.

TECHNICAL FIELD

The present disclosure relates generally to fluid pumps, such as fluid pumps used for sea water.

BACKGROUND

Biofouling caused by bio-growth (e.g., salt water or fresh water marine growth) can result in the clogging of water systems, and the inefficient operation, overheating, and malfunction of equipment dependent upon the water systems thereby leading to costly downtime and expensive repair. For some applications, the issue of bio-growth within water systems is addressed by periodic (e.g., semi-annual) acid cleaning of the water systems. Acid cleaning is expensive, time consuming, and involves the use of harsh and hazardous chemicals. Systems have also been developed to treat water systems in real-time to prevent bio-fouling through the in-situ generation of biocide within the water passing through the water systems (e.g., see U.S. Pat. No. 11,027,991). However, in such treatment systems, reduction or elimination of dead and/or low flow regions are desired to ensure the biocide treats the flow of water.

Some of these water systems include pumps to generate water flow. At least some pumps include a volute wall that facilitates converting the water's velocity to pressure within the pump. These volute walls, however, are known to form a secondary cavity within the pump that is a dead and/or low flow region of the pump and where bio-growth occurs. As such, improvements are desired. Additionally, the pump may be formed from a plastic material housing and water system components are configured to couple to the housing such that increased strength is desired.

SUMMARY

One aspect of the present disclosure relates to a seawater fluid pump having a pump face main housing body with an integrally formed volute wall that removes secondary cavities within a fluid chamber of the pump. Accordingly, dead and/or low flow regions of the pump are reduced and/or eliminated and the fluid pump only includes one main fluid chamber for fluid flow. Additionally, or alternatively, a port reinforcement ring is provided to increase port strength of the main housing body.

In an aspect, the technology relates to a pump including: a containment shell; a seal supported on the containment shell; a main housing body coupled to the containment shell, the main housing body sealed relative to the containment shell via the seal and defining a pump chamber therein; an impeller shaft disposed within the pump chamber; and an impeller coupled to the impeller shaft and configured to rotate around an axis of rotation; wherein the main housing body, the containment shell, or the main housing body and the containment shell define a volute wall having an inner surface at least partially forming the pump chamber and an exterior surface at least partially forming an outer surface of the pump, and wherein the volute wall prevents a secondary cavity from being formed within the pump chamber having low or no fluid flow therein.

In an example, the volute wall includes a circumferential portion and a radial portion. In another example, the circumferential portion and the radial portion are disposed within the seal of the pump. In still another example, the volute wall includes a first end disposed proximate an outlet of the main housing body and an opposite second end, the radial portion having a larger radial thickness at the first end than at the second end. In yet another example, the radial portion is disposed directly adjacent the containment shell. In an example, the circumferential portion and the radial portion are substantially orthogonal to each other.

In another example, the outer surface of the pump includes at least one recessed cavity formed at least partially by the volute wall. In still another example, the main housing body is a molded plastic component and includes the volute wall. In yet another example, the volute wall is not sealed relative to the containment shell.

In another aspect, the technology relates to a method of manufacturing a pump, the method including: providing a containment shell; providing a main housing body; and sealing the main housing body relative to the containment shell and defining a pump chamber therein and housing an impeller coupled to an impeller shaft, wherein the main housing body, the containment shell, or the main housing body and the containment shell define a volute wall having an inner surface at least partially forming the pump chamber and an exterior surface at least partially forming an outer surface of the pump, and wherein the volute wall prevents a secondary cavity from being formed within the pump chamber having low or no fluid flow therein.

In an example, providing the main housing body includes molding the main housing body from plastic and the main housing body includes the volute wall. In another example, the method further includes integrating a port reinforcing ring at an inlet port of the main housing body.

In another aspect, the technology relates to a housing including: a body having a molded plastic construction including plastic material defining a port for fluid communication through the body, the plastic material defining a helical thread within the port; and a port reinforcing ring integrated with the body and surrounding a port axis of the port for reinforcing the plastic material of the body defining the port, the port reinforcing ring having a metal construction.

In an example, the body includes a port projection that projects from a face of the body and defines the helical thread inside the port projection, and the port reinforcing ring is constructed as a cap secured on the port projection, the cap including a circumferential portion having an inner surface facing radially toward the port axis and a flange portion that projects radially inwardly from the circumferential portion and opposes an axial end of the port projection. In another example, the flange portion is oriented perpendicularly relative to the port axis. In still another example, the inner surface of the circumferential portion of the cap opposes an outer circumferential surface of the port projection, and the inner surface of the circumferential portion defines at least one interlock structure to provide an interlock between the cap and the plastic material of the port projection to provide retention of the cap on the port projection. In yet another example, the interlock structure includes a circumferential groove. In an example, the body includes gussets integrally molded with the outer circumferential surface of the port projection and also integrally molded with the face of the body for reinforcing the port projection.

In another example, the cap defines at least one interlock structure to provide an interlock between the cap and the plastic material of the port projection during molding of the port projection for improved adherence of the cap to the plastic material forming the port projection. In still another example, the housing is a pump housing defining an inner pumping chamber, an inlet, and an outlet, the pump housing including: an impeller rotationally mounted in the pump housing for moving within the pumping chamber from the inlet to the outlet; and the port in the body is in fluid communication with the pumping chamber which corresponds to the inlet or the outlet, the plastic material defining a helical thread within the port.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples described herein are based.

BRIEF DESCRIPTION OF THE DRAWINGS

The accompanying drawings, which are incorporated in and constitute a part of the specification, illustrate aspects of the present disclosure and together with the description, serve to explain the principles of the disclosure. A brief description of the drawings is as follows.

DETAILED DESCRIPTION

Figure 1:
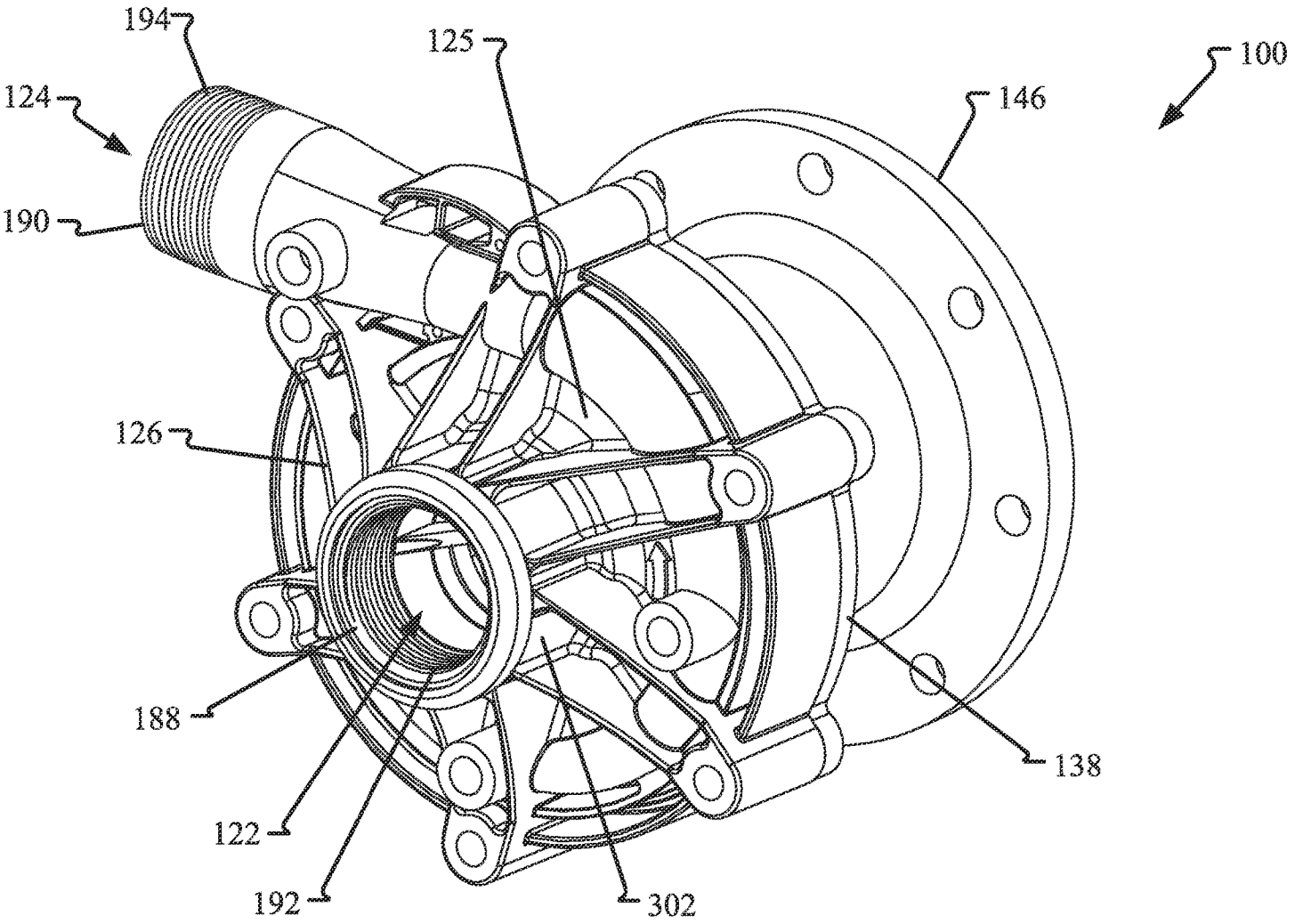
FIG. 1 is a partial perspective view of a fluid pump in accordance with the principles of this disclosure.

A fluid pump includes a housing that is formed such that an interior pump chamber does not include any secondary fluid chambers that have a reduced or no flow fluid condition. In the examples, a volute wall is integrally formed with an outer housing structure and includes both a circumferential portion and a radial portion that projects within the pump chamber. This configuration reduces or prevents biogrowth and bio-fouling within the pump while facilitating pump performance and the functionality of the volute wall. Additionally, or alternatively, a port reinforcement ring is provided at a port of the housing so as to increase strength thereof.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," "an example," "an aspect," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other examples whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C). Moreover, one having skill in the art will understand the degree to which terms such as "about," "approximately," or "substantially" convey in light of the measurements techniques utilized herein. To the extent such terms may not be clearly defined or understood by one having skill in the art, the term "about" shall mean plus or minus ten percent.

In the drawings, some structural or method features may be shown in specific arrangements and/or orderings. However, it should be appreciated that such specific arrangements and/or orderings may not be required. Rather, in some examples, such features may be arranged in a different manner and/or order than shown in the illustrative figures. Additionally, the inclusion of a structural or method feature in a particular figure is not meant to imply that such feature is required in all examples and, in some examples, may not be included or may be combined with other features.

Throughout this description, references to orientation (e.g., front (ward), rear (ward), top, bottom, back, right, left, upper, lower, etc.) of the components of the pump relate to their position when installed and in use, and are used for ease of description and illustration only. No restriction is intended by use of the terms regardless of how the components of the pump are situated on its own. As used herein, the terms "axial" and "longitudinal" refer to directions and orientations, which extend substantially parallel to a centerline of the component or system. Moreover, the terms "radial" and "radially" refer to directions and orientations, which extend substantially perpendicular to the centerline of the component or system. In addition, as used herein, the term "circumferential" and "circumferentially" refer to directions and orientations, which extend arcuately about the centerline of the component or system.

Figure 2:
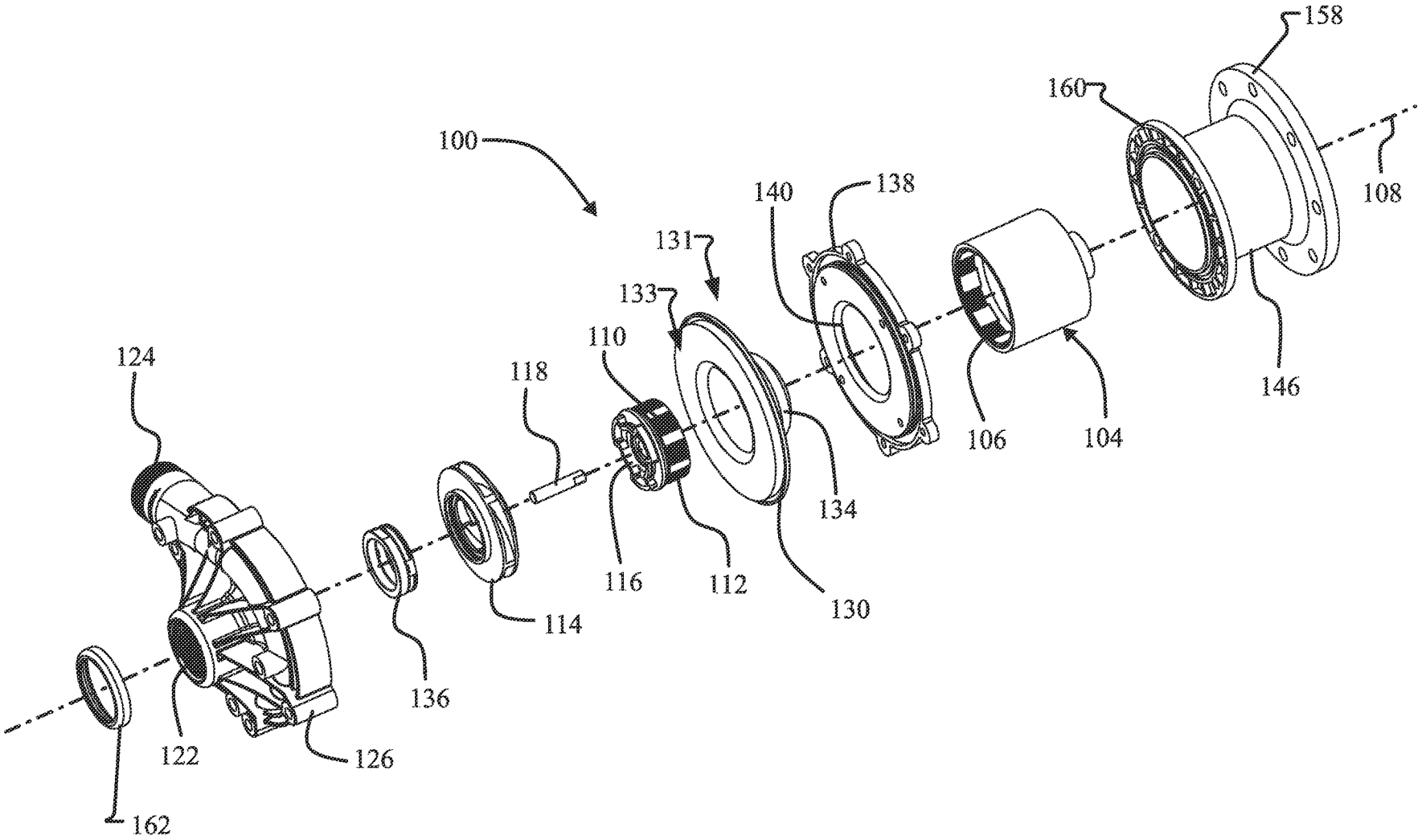
FIG. 2 is a partial exploded, perspective view of the fluid pump of FIG. 1.
Figure 3:
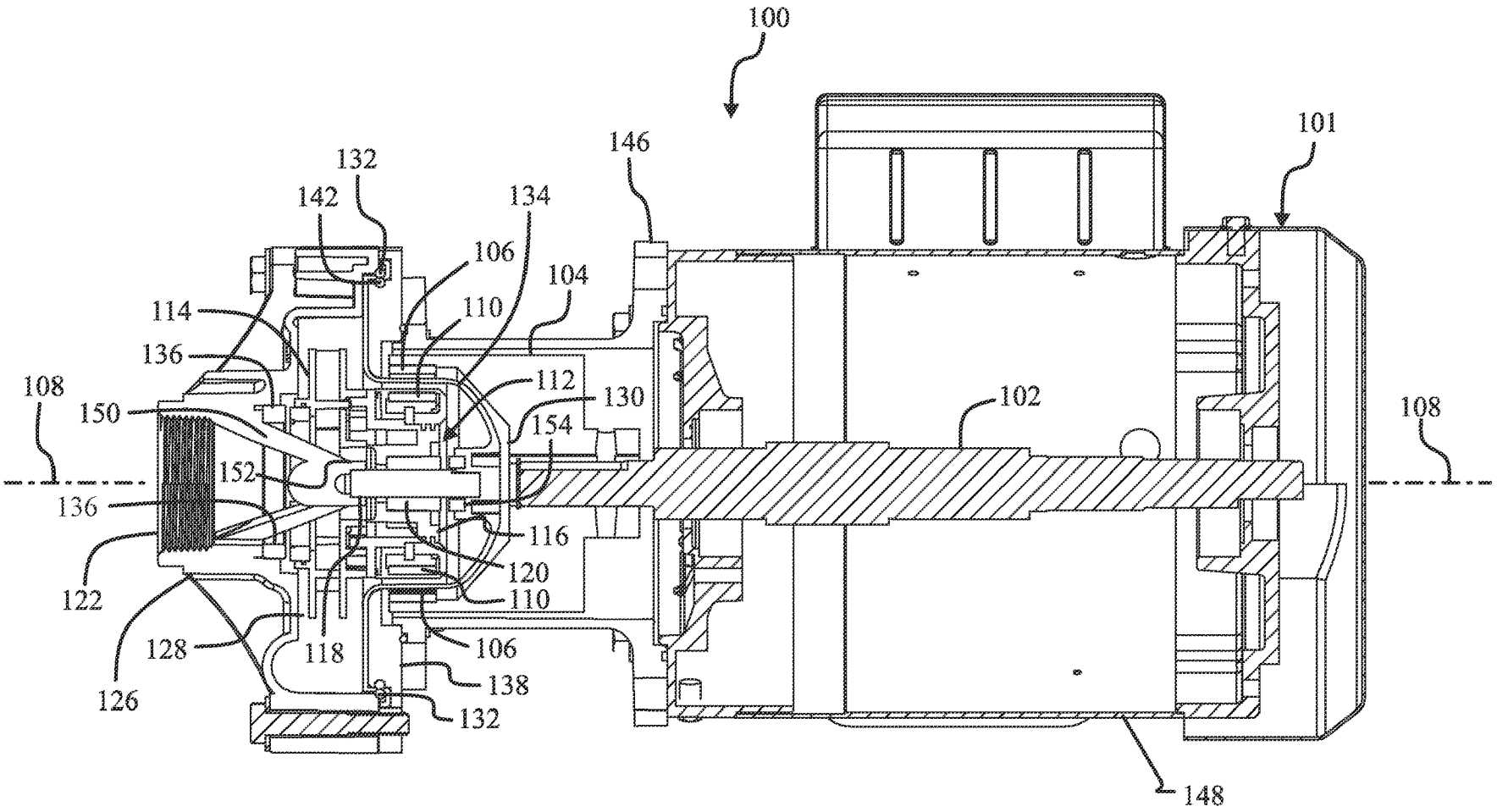
FIG. 3 is a longitudinal cross-sectional view of the fluid pump of FIG. 1 cut through a central drive shaft.
Figure 4:
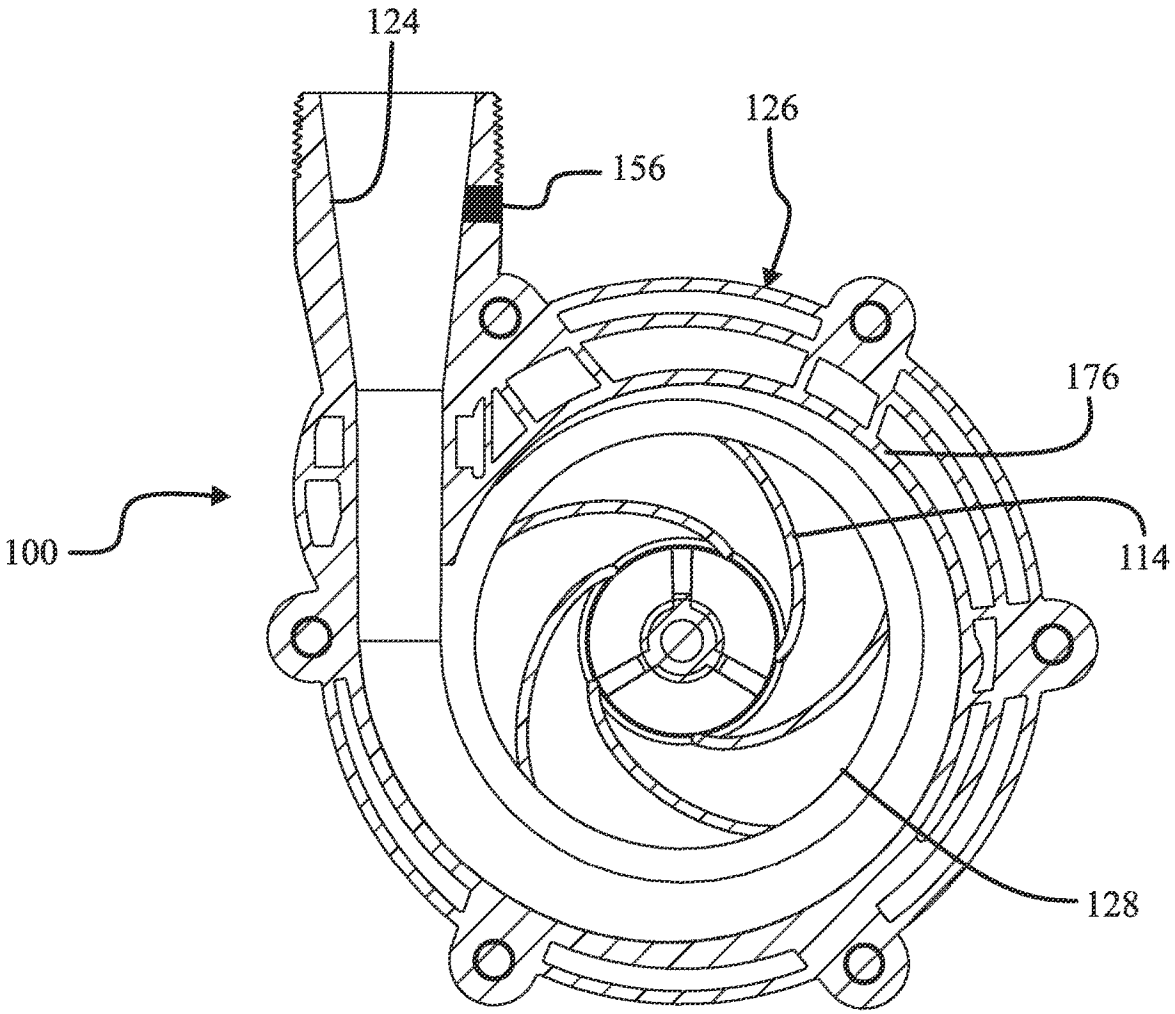
FIG. 4 is a transverse cross-sectional view of the fluid pump of FIG. 1, cut though an outlet.

FIG. 1 is a partial perspective view of a fluid pump 100 (e.g., a liquid pump such as a marine grade water pump). FIG. 2 is a partial exploded, perspective view of the fluid pump 100. FIG. 3 is a longitudinal cross-sectional view of the fluid pump 100. FIG. 4 is a transverse cross-sectional view of the fluid pump 100. Referring concurrently to FIGS. 1-4, the fluid pump 100 is a centrifugal pump; but other pump styles are also contemplated herein. The pump 100 includes a motor 101 (e.g., an electric motor) having a drive shaft 102 that drives rotation of a magnetic drive housing 104 supporting a plurality of first magnets 106. The magnets 106 are supported by the magnetic drive housing 104 circumferentially about an axis of rotation 108 of the drive shaft 102 and drive housing 104. The magnets 106 are supported to face radially toward the axis of rotation 108. A mechanical torque transmitting connection is provided between the drive housing 104 and the drive shaft 102 (e.g., a keyed connection; a splined connection; a connection with opposing flats such as a hexagonal interface, etc.).

The magnets 106 of the magnetic drive housing 104 are adapted to be magnetically coupled with a plurality of second magnets 110 of a magnet arrangement 112 corresponding to an impeller 114 of the pump 100. The magnet arrangement 112 includes a magnet support body 116 that supports the magnets 110 circumferentially about the axis of rotation 108 with the magnets 110 facing radially away from the axis of rotation 108 and in opposition with respect to the magnets 106 of the magnetic drive housing 104. The magnets 106, 110 provide a magnetic coupling between the magnetic drive housing 104 and the magnet arrangement 112 that allows torque to be magnetically transferred from the magnetic drive housing 104 to the magnet arrangement 112. The magnet support body 116 couples with the impeller 114 (e.g., interlocks with the impeller 114) such that the magnet support body 116 and the impeller 114 are adapted to rotate together in unison about the axis of rotation 108.

The magnet support body 116 rotationally mounts on an impeller shaft 118 aligned along the axis of rotation 108. A bearing 120 (e.g., a bushing) is provided between the magnet support body 116 and the impeller shaft 118 for supporting rotation of the magnet support body 116 and the impeller 114 about the impeller shaft 118.

The pump 100 includes an inlet 122 and an outlet 124. As depicted, the inlet 122 is an axial inlet having an axis that aligns with the axis of rotation 108 and the outlet 124 is a radial outlet having an axis that is radially oriented relative to the axis of rotation 108. The inlet 122 and the outlet 124 are defined by a main housing body 126 having a polymeric construction (e.g., molded plastic). The main housing body 126 may also be referred to as a pump face. The main housing body 126 also defines a pump chamber 128 in which the impeller 114 rotates to pump liquid (e.g., water) from the inlet 122 to the outlet 124. Rotation of the impeller 114 is driven by torque from the electric motor 101 which is transferred to the impeller 114 through the magnetic coupling.

A containment shell 130 (e.g., a barrier) attaches to the main housing body 126 in a sealed manner (e.g., via a gasket such as seal 132) to seal the pump chamber 128 and block fluid communication between the magnetic drive housing 104 and the pump chamber 128. In this way, the electric motor 101 and the magnetic drive housing 104 are not exposed to the liquid being pumped through the pump 100. The impeller shaft 118, the bearing 120, the impeller 114, and the magnet arrangement 112 are all disposed within the pump chamber 128 and exposed to liquid within the pump chamber 128 that is being pumped through the pump chamber 128 by the impeller 114. The liquid being pumped thereby provides cooling for the parts within the pump chamber 128. The magnet arrangement 112 fits within a sleeve 134 defined by the containment shell 130. The sleeve 134 separates (e.g., mechanically isolates) the magnet arrangement 112 from the magnetic drive housing 104 to prevent liquid from the pump chamber 128 from contacting the electric motor 101 and magnetic drive housing 104; but allows the magnetic coupling of the magnet arrangement 112 and the magnetic drive housing 104 such that torque from the electric motor 101 can be transferred through the magnetic coupling to drive rotation of the magnet arrangement 112 and the impeller 114 about the impeller shaft 118 within the pump chamber 128. The containment shell 130 has a first side 131 and an opposite second side 133. The second side 133 includes an annular groove that receives the seal 132 such as an O-ring seal.

A thrust bearing 136 provides a rotational interface between the impeller 114 and the interior of the main housing body 126 to prevent contact between the impeller 114 and the main housing body 126. Opposite ends of the thrust bearing 136 can fit within pockets defined by the main housing body 126 and the impeller 114.

An outer housing 138 of the pump 100 includes the main housing body 126 and a cover 140 that attaches to the main housing body 126 and covers the containment shell 130. A gasket 142 can provide sealing between the cover 140 and the containment shell 130. The cover 140 includes a central opening 144 through which the sleeve 134 extends. The sleeve 134 extends through the opening 144 beyond the cover 140 such that the magnetic drive housing 104 can fit over the sleeve 134 without interference from the cover 140. An outer connection sleeve 146 connects between the cover 140 and a motor housing 148 of the electric motor 101. The outer connection sleeve 146 covers the magnetic drive housing 104 and opposite ends of the sleeve 134 can be sealed (e.g., with gaskets such as O-rings) with respect to the cover 140 and the motor housing 148. The outer connection sleeve 146 is also known as an adapter and includes a first end 158 and an opposite second end 160. The first end 158 is configured to couple to the motor housing 148. The second end 160 is configured to support the outer housing 138 of the pump 100.

Opposite ends of the impeller shaft 118 are supported by the main housing body 126 and the containment shell 130. For example, the main housing body 126 includes a support structure including legs 150 extending from the inlet 122 and a sleeve 152 for supporting one end of the impeller shaft 118 and the containment shell 130 includes a support structure including a sleeve 154 for supporting the opposite end of the impeller shaft 118. The main housing body 126, the legs 150, the sleeve 152, the containment shell 130, the sleeve 154, and the magnet support body 116 can all have a polymeric (e.g., plastic) construction. The impeller shaft 118 can have a metal or ceramic construction. In aspects, one or more liquid detection sensors (e.g., sensor 156) may be coupled to the pump 100 and for detecting whether sufficient liquid (e.g., water) is in the pump 100 for the pump to operate properly such that heat sensitive parts are bathed in liquid for cooling. In certain examples, the liquid detection sensor is mounted adjacent the outlet 124 of the pump 100 or elsewhere in the pump 100 as required or desired.

A reinforcement ring 162 is provided at the inlet 122 and is described further below in reference to FIG. 9. While a magnetic drive fluid pump is described herein, it is appreciated that the concepts regarding a volute wall are applicable to any other seawater fluid pump as required or desired.

Figure 5:
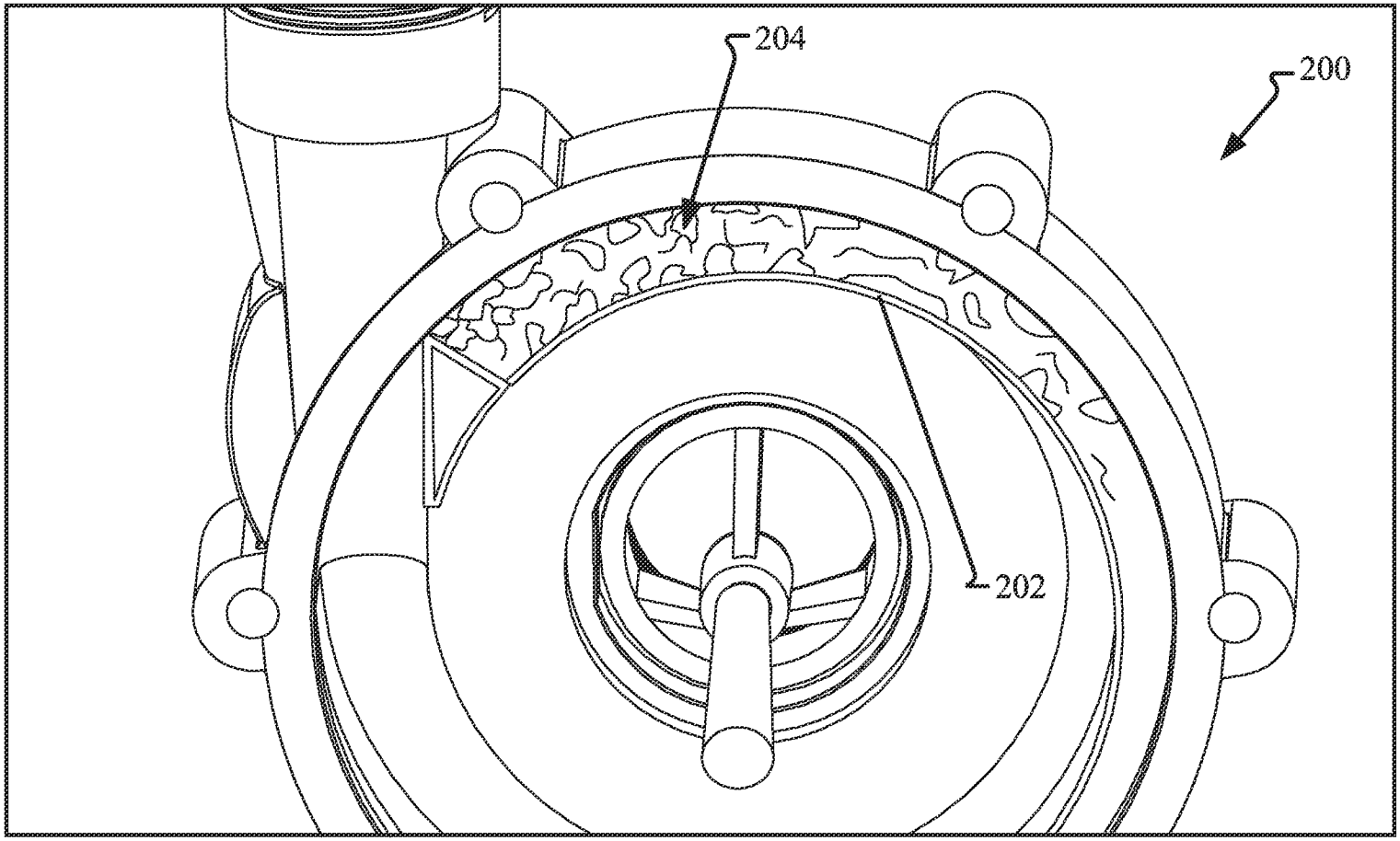
FIG. 5 (PRIOR ART)
FIG. 5 is an interior view of a prior art main housing body.

FIG. 5 is an interior view of a prior art main housing body 200 (e.g., pump face). The main housing body 200 includes a volute wall 202 that is spiral-shaped relative to the axis of rotation so as to convert the liquid's velocity to pressure as the impeller (not shown) discharges the liquid through the fluid pump chamber and towards the outlet. In this design, the volute wall 202 is formed independent from the main front axial face wall of the main housing body 200 (e.g., extends from an inner surface of the axial wall) and with a secondary cavity 204 formed between a circumferential portion of the main housing body 200 and the volute wall 202. The volute wall 202 may only include a circumferential portion thereby defining the secondary cavity 204 between it and a sidewall of the main housing body 200. This secondary cavity 204 is not sealed relative to the containment shell (not shown) as having more than one seal layer (e.g., the O-ring seal) may compromise the seal of the fluid pump chamber. As such, water can penetrate the secondary cavity 204 and flow within the secondary cavity 204 is either dead or very low. As such, bio-fouling as illustrated in FIG. 5 can occur within secondary cavity 204 and this is undesirable.

Figure 6:
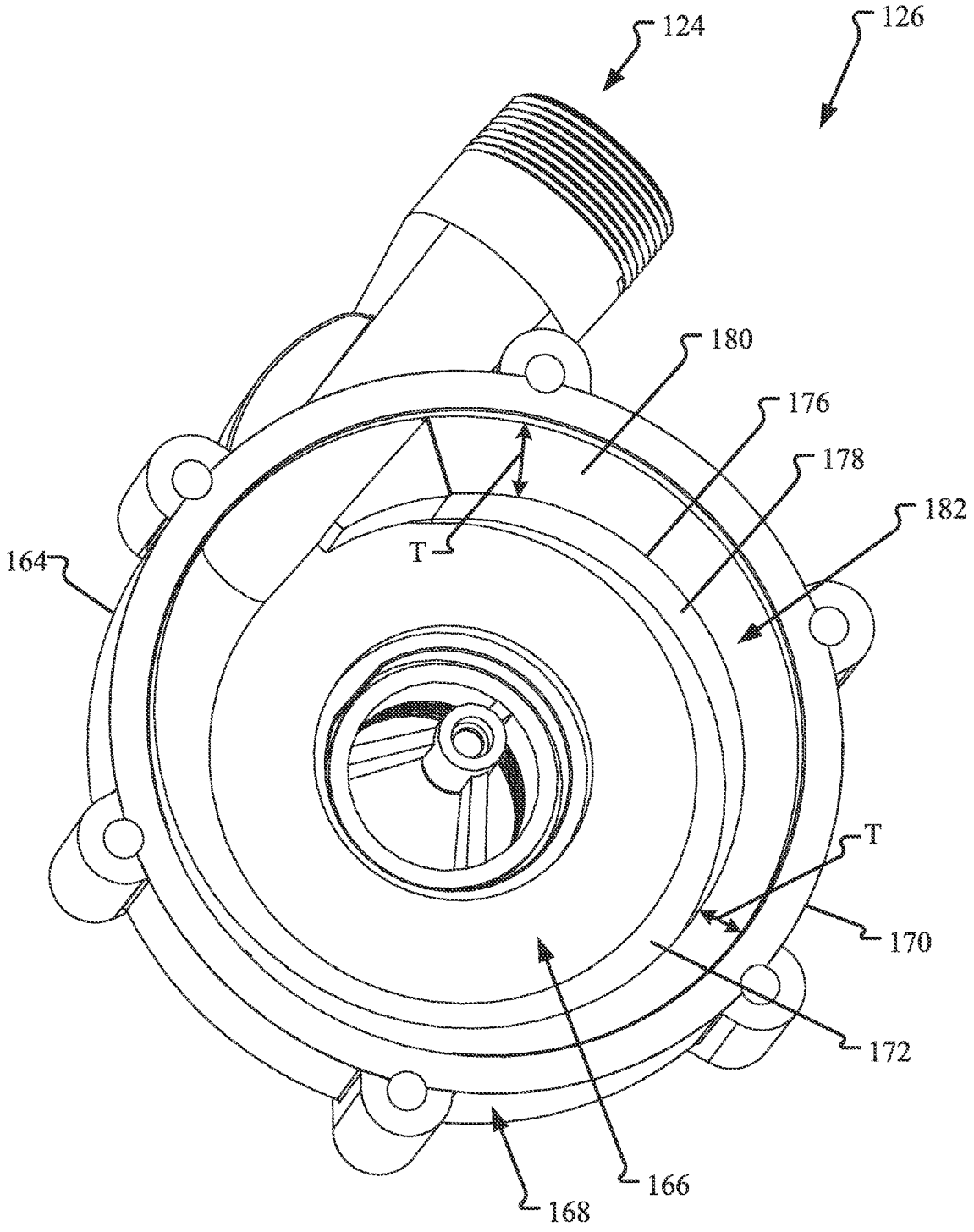
FIG. 6 is an interior, perspective view of a main housing body of the fluid pump of FIG. 1.
Figure 7:
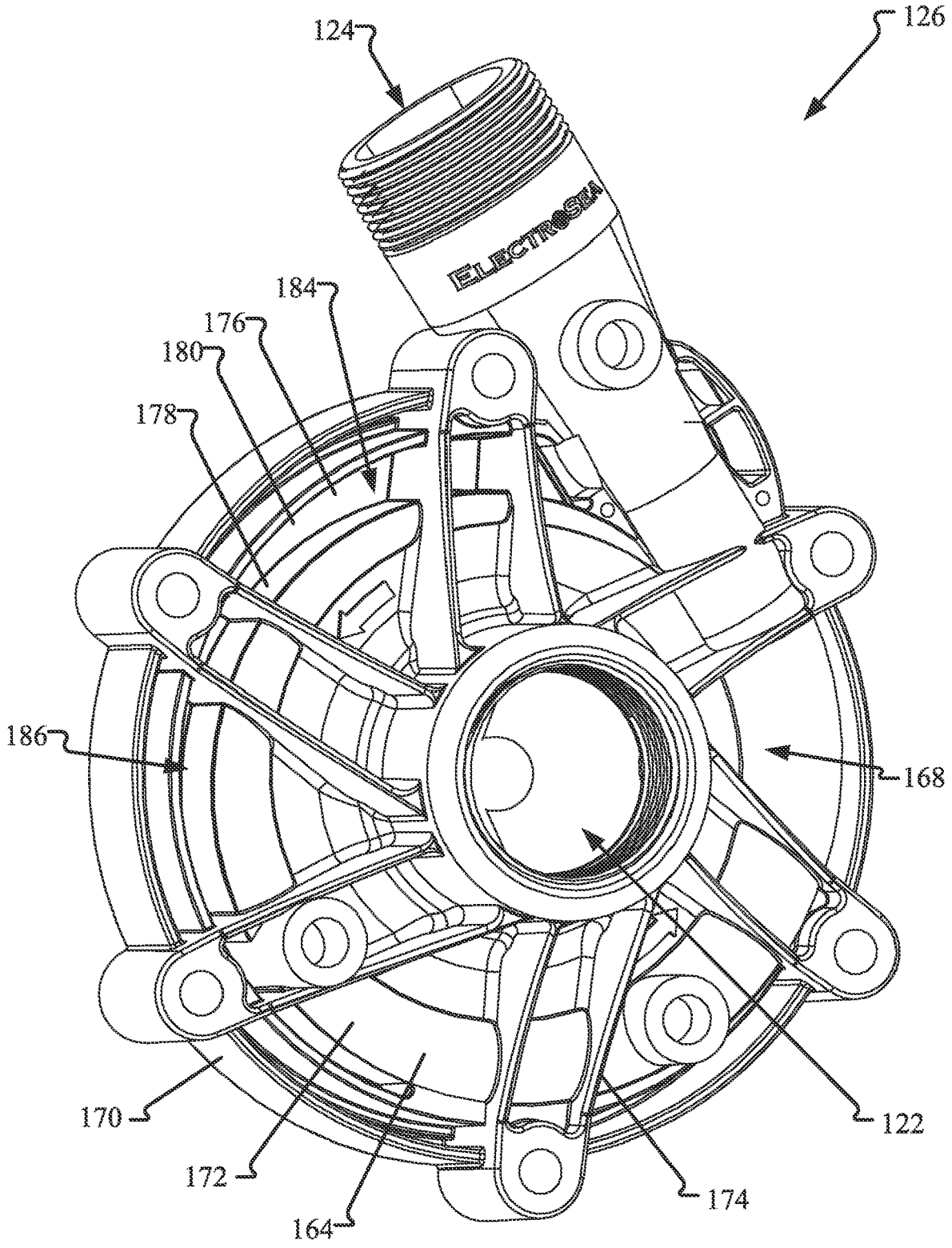
FIG. 7 is an exterior, perspective view of the main housing of the fluid pump of FIG. 1.

FIG. 6 is an interior, perspective view of the main housing body 126. FIG. 7 is an exterior, perspective view of the main housing body 126. Referring concurrently to FIGS. 6 and 7, the main housing body 126 is a molded plastic component and generally has a main wall 164 with an inner surface 166 that forms the pump chamber 128 (shown in FIG. 3) and an opposite exterior surface 168. The exterior surface 168 forms the exterior of the pump 100 (shown in FIG. 1). The main wall 164 includes a cylindrical sidewall portion 170 that is configured to couple against the second side 133 of the containment shell 130 and seal against the containment shell 130 with the seal 132 (shown in FIGS. 2 and 3). The outlet 124 extends from the cylindrical sidewall portion 170. The main wall 164 also includes an axial wall portion 172 that forms the inlet 122. The exterior surface 168 of the axial wall portion 172 includes one or more gussets 174 providing structural support for the inlet 122. The gussets 174 are disposed on the exterior surface 168. Generally, the cylindrical sidewall portion 170 of the main wall 164 circumferentially surrounds the axis of rotation 108 (shown in FIG. 2), while the axial wall portion 172 of the main wall 164 is axially positioned relative to the axis of rotation 108 and orthogonal thereto. As such, the main wall 164 forms a recessed cavity at the inner surface 166 and that at least partially defines the pump chamber 128. The seal 132 is positioned at the cylindrical sidewall portion 170 and the cylindrical sidewall portion 170 is configured to be coupled to other components of the pump 100.

The main wall 164 further includes a volute wall 176. The volute wall 176 includes a circumferential portion 178 that is parallel with, but offset from, the cylindrical sidewall portion 170 and a radial portion 180 that is parallel with, but offset from, the axial wall portion 172. As such, the volute wall 176 is formed with two substantially orthogonal portions relative to the axis of rotation 108. The volute wall 176 has an inner surface 182 that at least partially forms the pump chamber 128 and is a portion of the inner surface 166 of the main wall 164, and an opposite outer surface 184 that is a portion of the exterior surface 168 of the main wall 164. Accordingly, the volute wall 176 is integrally formed within the main wall 164 and is a portion thereof.

The volute wall 176 at the inner surface 166 of the main wall 164 is formed as a projection into the recessed cavity and the pump chamber 128, and so that no secondary cavities are formed by the volute wall 176, unlike the prior art design shown in FIG. 5. The inner surface 166 of the volute wall 176 is not sealed with respect to the containment shell 130 so that the main seal of the pump chamber 128 remains and need not be reconfigured. The projection of the volute wall 176 into the pump chamber 128 facilitates pump performance while also not forming any dead or low flow cavities within the pump chamber 128. As illustrated in FIG. 4, the volute wall 176 is integral with the main housing body 126, and because the volute wall 176 has both a circumferential portion and a radial portion forming the projection, the functionality of the cylindrical sidewall portion 170 is retained.

The volute wall 176 at the exterior surface 168 of the main wall 164 is formed as a recess such that the volute wall 176 at least partially defines one or more recessed cavities 186 on the exterior surface 168. The recessed cavity 186 is formed by the outer surface 184 of the volute wall 176. In aspects, the gussets 174 may intersect the recessed cavity 186. The recessed cavities 186 do not receive a flow of water as they are external to the pump chamber 128.

The spiral geometry of the volute wall 176 may be defined by the flow characteristics of the pump 100 and only one possible geometry is illustrated in the example described herein. The pump 100 may also include more than one volute wall as required or desired. The impeller 114 (shown in FIG. 2) is radially inside of the volute wall 176. In the example, the volute wall 176 extends only partially around the axis of rotation 108. In an aspect, the volute wall 176 may extend about 180° about the axis of rotation 108. The volute wall 176 is radially tapered T, such that the end proximate the outlet 124 has a greater radial distance from the circumferential portion 178 to the cylindrical sidewall portion 170 than the end disposed away from the outlet 124.

In other examples, the volute wall 176 may be defined on the containment shell 130 as required or desired and directly face the main housing body 126. In still other examples, the volute wall 176 may be defined on both the containment shell 130 and the main housing body 126. In any configuration, the volute wall 176 prevents secondary cavities from being formed within the pump chamber 128.

Figure 8:
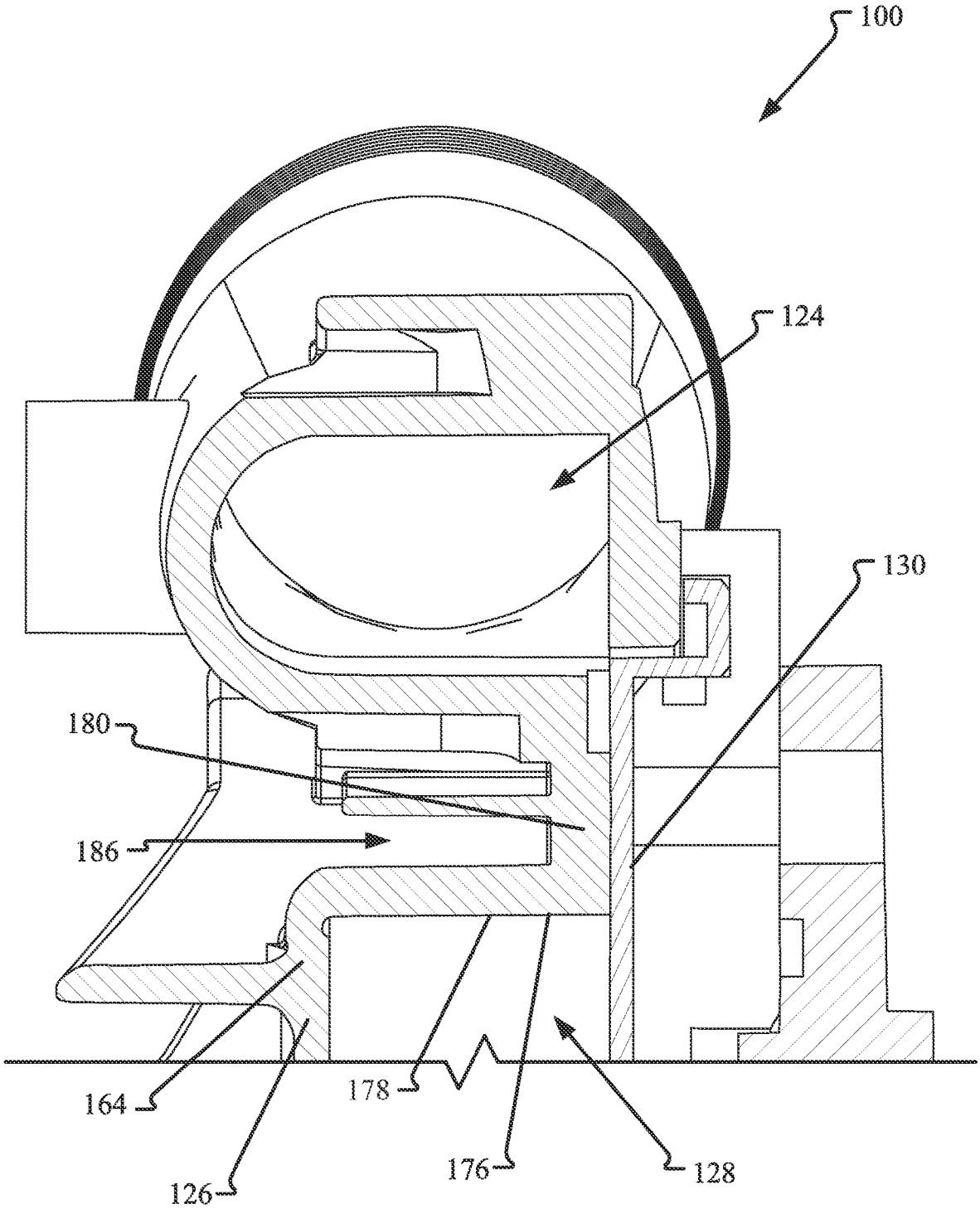
FIG. 8 is an enlarged, cross-sectional view of a volute wall of the fluid pump of FIG. 1.

FIG. 8 is an enlarged, cross-sectional view of the volute wall 176 of the fluid pump 100 proximate the outlet 124. The radial portion 180 is parallel to and positioned directly against the containment shell 130. This boundary however is not sealed. Rather, because the radial portion 180 extends from the distal end of the circumferential portion 178 of the volute wall 176, no secondary cavity is formed within the pump chamber 128 and bio-fouling around the volute wall 176 is restricted or prevented. If water does penetrate between the volute wall 176 and the containment shell 130, the pressure within the pump chamber 128 will cause the water to continue to flow towards the outlet 124 during operation or drain back into the pump chamber 128 when the pump 100 is not in operation.

The radial portion 180 of the volute wall 176 is substantially orthogonal to the circumferential portion 178. The volute wall 176 may form a substantially L-shaped section of the main wall 164 of the main housing body 126 and is part of the main wall 164 that is disposed away from the seal with the containment shell 130. The L-shaped section forms the projection of the volute wall 176 within the pump chamber 128.

In the depicted example of FIGS. 1 and 2, the main housing body 126 (e.g., the pump face) has a molded plastic construction with the plastic material of the axial wall portion 172 defining an inlet port 188 of the inlet 122 and an outlet port 190 of the outlet 124. The main housing body 126 can also be referred to as a pump housing or a portion of a pump housing defining a pump chamber. In the example, The inlet port 188 defines internal helical threads 192 within the inlet port 188 and the outlet port 190 includes external helical threads 194 around an exterior of the outlet port 190.

Figure 9:
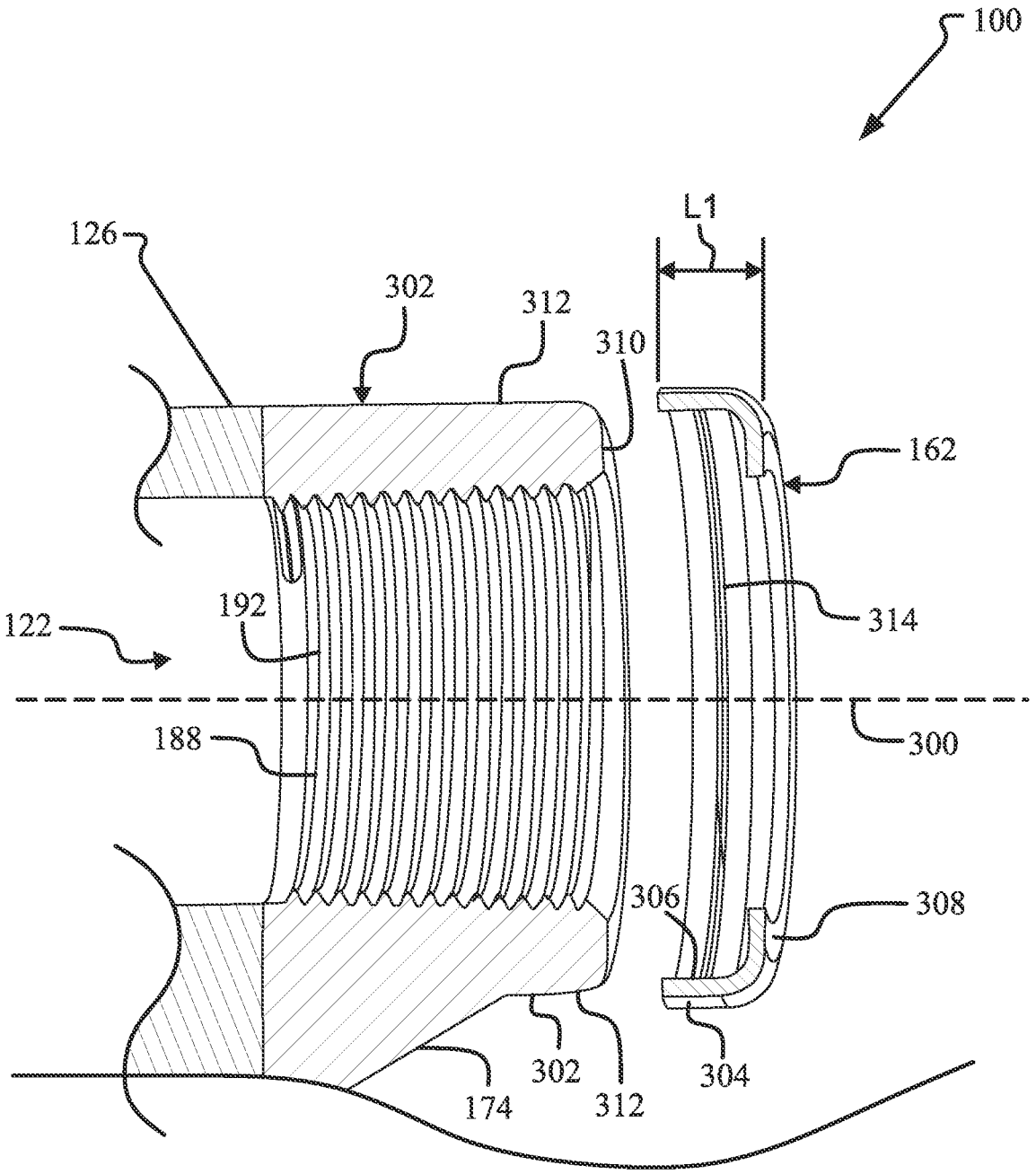
FIG. 9 is a cross-sectional view of a reinforced inlet port of the fluid pump of FIG. 1.

FIG. 9 is a cross-sectional view of a reinforced inlet port 188 of the fluid pump 100. The port reinforcing ring 162 is integrated with the main housing body 126 and surrounds a port axis 300 of the inlet port 188 of the inlet 122 for reinforcing the plastic material of the main housing body 126 defining the inlet port 188. The port reinforcing ring 162 can have a metal construction such as steel (e.g., stainless steel), titanium or other metals. The main housing body 126 includes a front face 125 (see FIG. 1) and a port projection 302 (see FIGS. 1 and 8) projects forwardly from the front face 125. The inlet port 188 extends through the port projection 302 and is in fluid communication with an inner pump chamber 128 (shown in FIG. 2) of the pump 100. The port reinforcing ring 162 is constructed as a cap secured on the port projection 302. The ring 162 includes a circumferential portion 304 having an inner surface 306 facing radially toward the axis 300 of the port 188 and a flange portion 308 that projects radially inwardly from the circumferential portion 304 and opposes an axial end 310 of the port projection 302.

As depicted at FIG. 9, the flange portion 308 is oriented perpendicularly relative to the axis 300 of the inlet port 188. The inner surface 306 of the circumferential portion 304 of the ring 162 opposes an outer circumferential surface 312 of the port projection 302. The inner surface 306 of the circumferential portion 304 defines an interlock structure such as at least one recess 314 into which plastic material of the port projection 302 is molded to provide retention of the ring 162 on the port projection 302. Alternatively, the ring 162 can include an interlock structure such as at least one projection/protrusion over which the plastic material of the port projection 302 is molded such that the projection/protrusion embeds in the plastic material to provide enhanced retention. The ring 162 provides enhanced hoop strength to the port projection 302 which assists in preventing deformation and/or cracking when fittings are threaded in the inlet port 188. In certain examples, the recess 314 defines a channel into which portions of liquid plastic material of the main housing body 126 can flow and cure/solidify during molding/formation of the port projection 302 of the main housing body 126 for improved adherence of the ring 162 to the plastic material forming the port projection 302. In certain examples, the recess 314 is a circumferential groove having an open side that faces radially inwardly toward the axis 300. An outer surface of the circumferential portion 304 may be substantially smooth and free of any recesses and/or projections.

The main housing body 126 includes gussets 174 integrally (e.g., unitarily) molded with the outer circumferential surface 312 of the port projection 302 and also integrally (e.g., unitarily) molded with the front face 125 of the main housing body for reinforcing the port projection 302 relative to the front face 125. In certain examples, the ring 162 has an axial length L1 that extends from the axial end 310 of the port projection 302 to the gussets 174. In an aspect, the recess 314 may be disposed around a midpoint of the axial length L1. In other aspects, the recess 314 may be disposed closer to the distal end of the ring 162 than the flange end.

In an aspect, the transition area between the circumferential portion 304 and the flange portion 308 of the ring 162 may be rounded and corresponds to the shape of the axial end 310 of the port projection 302.

In the example, the reinforced port projection is described as being part of an inlet port of a fluid pump. It is appreciated, that the outlet port of the fluid pump may additionally or alternatively be reinforced with the reinforcement ring. In still other examples, the main housing body defining the port projection may be part of any other housing system that facilities flow communication and having a threaded port connection. For example, the port projection with the reinforcement ring may be included in an electrolytic biocide-generating device and as incorporated by reference herein. The reinforcement ring may be used in combination with the volute wall described herein, or each may be utilized individually and separately.

Figure 10:
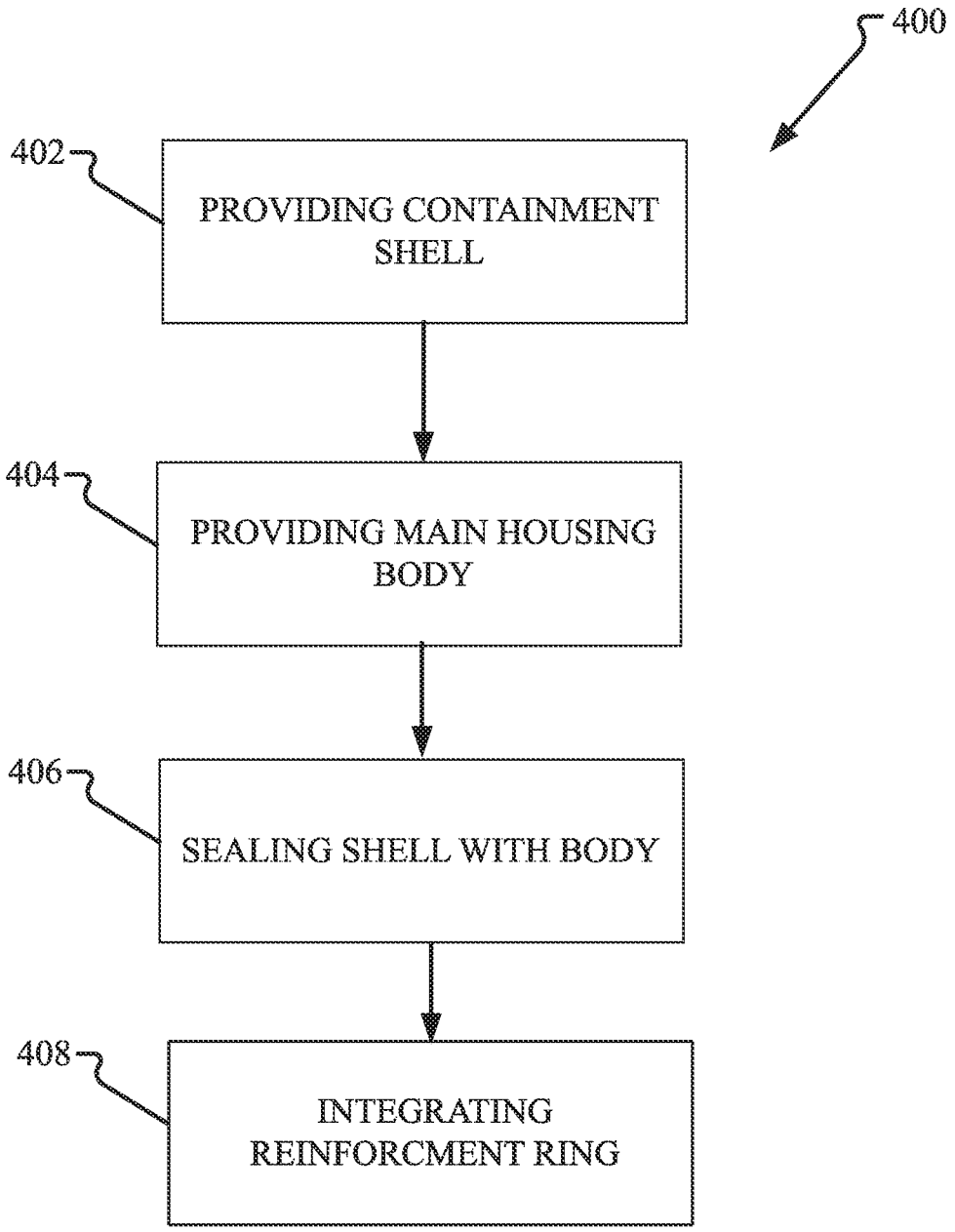
FIG. 10 is a flowchart illustrating an exemplary method of manufacturing a pump.

FIG. 10 is a flowchart illustrating an exemplary method 400 of manufacturing a pump. The example methods and operations can be implemented or performed by the assemblies described herein (e.g., the pump 100 shown in FIGS. 1-9). The method 400 begins with providing a containment shell (operation 402) and providing a main housing body (operation 404). The containment shell is then sealable with the main housing body (operation 406). The containment shell and the main housing body defines a pump chamber therein and houses an impeller coupled to an impeller shaft. The main housing body, the containment shell, or the main housing body and the containment shell define a volute wall having an inner surface at least partially forming the pump chamber and an exterior surface at least partially forming an outer surface of the pump. The volute wall prevents a secondary cavity from being formed within the pump chamber having low or no fluid flow therein.

In the example, the volute wall is formed as a projection within the pump chamber and is disposed inside the seal perimeter between the containment shell and the main housing body. The main housing body may be formed from plastic and the main housing body can includes the volute wall. In some examples, the method 400 can include integrating a port reinforcing ring at an inlet port of the main housing body (operation 408).

The fluid pump described herein has a housing that is formed such that the interior pump chamber does not include any secondary chambers that have a reduced or no flow fluid condition. In the examples, the volute wall is integrally formed with the outer housing structure and includes both a circumferential portion and a radial portion that projects within the pump chamber. This configuration reduces or prevents bio-growth and bio-fouling within the pump. Additionally, or alternatively, a port reinforcement ring is provided at a port of the housing so as to increase strength thereof.

The various examples described above are provided by way of illustration only and should not be construed to limit the scope of the present disclosure. Those skilled in the art will readily recognize various modifications and changes that may be made with respect to the examples illustrated and described herein without departing from the true spirit and scope of the present disclosure.

What is claimed is:

1. A pump comprising:

a containment shell;

a seal supported on the containment shell;

a main housing body coupled to the containment shell, the main housing body sealed relative to the containment shell via the seal and defining a pump chamber therein;

an impeller shaft disposed within the pump chamber; and an impeller coupled to the impeller shaft and configured to rotate around an axis of rotation;

wherein the main housing body defines a volute wall having an inner surface at least partially forming the pump chamber and an exterior surface at least partially forming an outer surface of the pump, wherein the volute wall prevents a secondary cavity from being formed within the pump chamber having low or no fluid flow therein, wherein the volute wall includes a circumferential portion and a radial portion, the radial portion orthogonally extending from the circumferential portion and disposed against the containment shell, and wherein the outer surface of the pump includes at least one recessed cavity formed by three sections of the main housing body, the exterior surface of the circumferential portion of the volute wall, the exterior surface of the radial portion of the volute wall, and an outer cylindrical sidewall portion of the main housing body that is parallel to the circumferential portion of the volute wall and disposed radially outside of the circumferential portion.

2. The pump of claim 1, wherein the circumferential portion and the radial portion are disposed within the seal of the pump.

3. The pump of claim 1, wherein the volute wall includes a first end disposed proximate an outlet of the main housing body and an opposite second end, the radial portion having a larger radial thickness at the first end than at the second end.

4. The pump of claim 1, wherein the radial portion is disposed directly adjacent the containment shell.

5. The pump of claim 1, wherein the main housing body is a molded plastic component and includes the volute wall.

6. The pump of claim 1, wherein the volute wall is not sealed relative to the containment shell.

7. The pump of claim 1, wherein the main housing body has a molded plastic construction including plastic material defining a port for fluid communication through the main housing body, the port having a port projection extending along a port axis with an inner circumferential surface, an opposite outer circumferential surface, and an axial surface end extending therebetween, the plastic material defining a helical thread within the port and at least partially on the inner circumferential surface, the pump further comprising a port reinforcing ring having at least one interlock structure to provide an interlock between the port reinforcing ring and the main housing body such that the port reinforcing ring is integrated and non-removable with the main housing body, and surrounding the port axis of the port for reinforcing the plastic material of the main housing body defining the port, the port reinforcing ring having a metal construction, wherein the port reinforcing ring includes a circumferential portion and a flange portion projecting radially inwardly from the circumferential portion, the circumferential portion facing and contacting the outer circumferential surface of the port and the flange portion at least partially facing and contacting the axial surface end of the port.

8. A method of manufacturing a pump, the method comprising:

providing a containment shell;

providing a main housing body having a molded plastic construction including plastic material, wherein the main housing body defines an inlet port for fluid communication through the main housing body, the inlet port having a port projection extending along a port axis with an inner circumferential surface, an opposite outer circumferential surface, and an axial surface end extending therebetween, and wherein a helical thread is defined within the inlet port and at least partially on the inner circumferential surface;

sealing the main housing body relative to the containment shell and defining a pump chamber therein and housing an impeller coupled to an impeller shaft, wherein the main housing body, the containment shell, or the main housing body and the containment shell define a volute wall having an inner surface at least partially forming the pump chamber and an exterior surface at least partially forming an outer surface of the pump, and wherein the volute wall prevents a secondary cavity from being formed within the pump chamber having low or no fluid flow therein; and integrating a port reinforcing ring at the inlet port of the main housing body, wherein the port reinforcing ring has at least one interlock structure to provide an interlock between the port reinforcing ring and the main housing body such that the port reinforcing ring is integrated and non-removable with the main housing body, and surrounding the port axis of the inlet port for reinforcing the plastic material of the main housing body, the port reinforcing ring having a metal construction, wherein the port reinforcing ring includes a circumferential portion and a flange portion projecting radially inwardly from the circumferential portion, the circumferential portion facing and contacting the outer circumferential surface of the inlet port and the flange portion at least partially facing and contacting the axial surface end of the inlet port.

9. The method of claim 8, wherein providing the main housing body includes molding the main housing body from plastic and the main housing body includes the volute wall.

10. A housing comprising:

a body having a molded plastic construction including plastic material defining a port for fluid communication through the body, the port having a port projection extending along a port axis with an inner circumferential surface, an opposite outer circumferential surface, and an axial surface end extending therebetween, the plastic material defining a helical thread within the port and at least partially on the inner circumferential surface; and a port reinforcing ring having at least one interlock structure to provide an interlock between the port reinforcing ring and the body such that the port reinforcing ring is integrated and non-removable with the body, and surrounding the port axis of the port for reinforcing the plastic material of the body defining the port, the port reinforcing ring having a metal construction, wherein the port reinforcing ring includes a circumferential portion and a flange portion projecting radially inwardly from the circumferential portion, the circumferential portion facing and contacting the outer circumferential surface of the port and the flange portion at least partially facing and contacting the axial surface end of the port, wherein the housing is a pump housing defining an inner pumping chamber, an inlet, and an outlet, the pump housing comprising:

an impeller rotationally mounted in the pump housing for moving fluid within the pumping chamber from the inlet to the outlet; and the port in the body is in fluid communication with the pumping chamber which corresponds to the inlet or the outlet.

11. The housing of claim 10, wherein the flange portion is oriented perpendicularly relative to the port axis.

12. The housing of claim 10, wherein an inner surface of the circumferential portion defines the at least one interlock structure to provide the interlock between the port reinforcing ring and the plastic material of the port projection to provide retention of the port reinforcing ring on the port projection.

13. The housing of claim 12, wherein the interlock structure includes a circumferential groove.

14. The housing of claim 12, wherein the body includes gussets integrally molded with the outer circumferential surface of the port projection and also integrally molded with a face of the body for reinforcing the port projection.

15. The housing of claim 10, wherein the port reinforcing ring defines the at least one interlock structure to provide the interlock between the port reinforcing ring and the plastic material of the port projection during molding of the port projection for improved adherence of the port reinforcing ring to the plastic material forming the port projection.

16. The housing of claim 10, wherein the circumferential portion of the port reinforcing ring is at least partially embedded into the outer circumferential surface of the port, the plastic material of the circumferential surface of the port being molded over at least one interlock structure of the circumferential portion of the port reinforcing ring.

17. A housing comprising:

a body having a molded plastic construction including plastic material defining a port for fluid communication through the body, the port having a port projection extending along a port axis with an inner circumferential surface, an opposite outer circumferential surface, and an axial surface end extending therebetween, the plastic material defining a helical thread within the port and at least partially on the inner circumferential surface; and a port reinforcing ring including a circumferential portion and a flange portion projecting radially inwardly from the circumferential portion, the port reinforcing ring integrated with the body and surrounding the port axis of the port, the circumferential portion of the port reinforcing ring non-threadably coupled to the outer circumferential surface of the port such that the port reinforcing ring is non-removable from the port with the flange portion at least partially facing and contacting the axial surface end of the port, the port reinforcing ring having a metal construction for reinforcing the plastic material of the body defining the port.

18. The housing of claim 17, wherein the housing is a pump housing defining an inner pumping chamber, an inlet, and an outlet, the pump housing comprising:

an impeller rotationally mounted in the pump housing for moving fluid within the pumping chamber from the inlet to the outlet; and the port in the body is in fluid communication with the pumping chamber which corresponds to the inlet or the outlet.

* * * * *